United States Patent [19]

Chelin

[11] Patent Number: 4,611,357

[45] Date of Patent: Sep. 16, 1986

[54] FLOTATION SLEEPING MATTRESS CONSTRUCTIONS

[76] Inventor: Steven C. Chelin, 8612 Makaha Cir., Papillion, Nebr. 68128

[21] Appl. No.: 747,580

[22] Filed: Jun. 24, 1985

[51] Int. Cl.[4] ..... A47C 27/08

[52] U.S. Cl. ..... 5/451; 5/457

[58] Field of Search ..... 5/451, 452, 449, 450, 5/441, 457, 458

[56] References Cited

U.S. PATENT DOCUMENTS

| | | | |
|---|---|---|---|
| 585,834 | 7/1897 | Ruth | 5/457 |
| 2,549,597 | 4/1951 | Harris et al. | 5/457 |
| 3,748,669 | 7/1973 | Warner | 5/451 |
| 3,849,814 | 11/1974 | Ross | 5/451 |
| 3,925,835 | 12/1975 | Pennington et al. | 5/452 |
| 3,952,348 | 4/1976 | Benjamin | 5/451 |
| 4,067,078 | 1/1978 | Winston | 5/455 |
| 4,422,194 | 12/1983 | Viesturs et al. | 5/441 |
| 4,470,164 | 9/1984 | Soderstrom et al. | 5/451 |

FOREIGN PATENT DOCUMENTS

| | | | |
|---|---|---|---|
| 1274076 | 9/1961 | France | 5/457 |
| 8300814 | 10/1984 | Netherlands | 5/449 |

*Primary Examiner*—Alexander Grosz

*Attorney, Agent, or Firm*—George R. Nimmer

[57] ABSTRACT

Rudimentary prior art fluid-inflatable sleeping mattresses are of a simple six-sided shell construction having a spout for fluid introduction and evacuation. Disclosed are improved mattress constructions which, in addition to the prior art spouted six-sided shell, are internally provided with substantially parallel fluid-impervious baffle-panels resulting in solely terminally communicating internal chambers for the external shell and that drastically reduce abrupt fluid displacement phenomena as the reclining occupant moves about. For water-inflatable modes, one or more air-relief valves extend from internal chambers through the external shell to facilitate purging of air bubbles entrapped within the water flotation medium. An air-impervious cap for the spout means permits an internally baffled shell to be alternatively employed as an air-inflatable type flotation mattress.

5 Claims, 6 Drawing Figures

9
10
W
L
11M
11B
20F
20E
20D
20C
11
40G
40F
40E
40D
5
15
2A
2
3
12M
12
11A
14
12B
11N
17
4
13
16
12A
12N 3
4
5
18
17
40D
40E
11
40F
40G
11A
11B
13
14
20C
20D
20E
20F
30C
30D
30E
30F
30G
12A
12
12B
20W
W 2
21
11M
11
20C
40D
22
11N
15
30D
16
12M
21K
12
22K
12N
L

FIG. 4
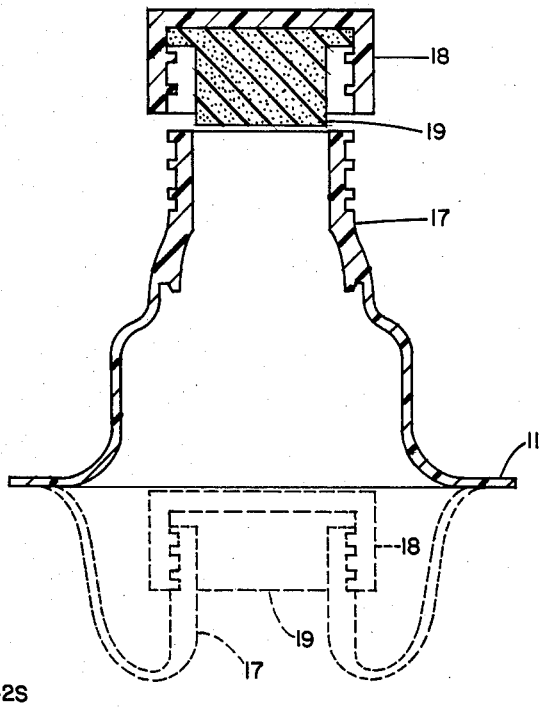
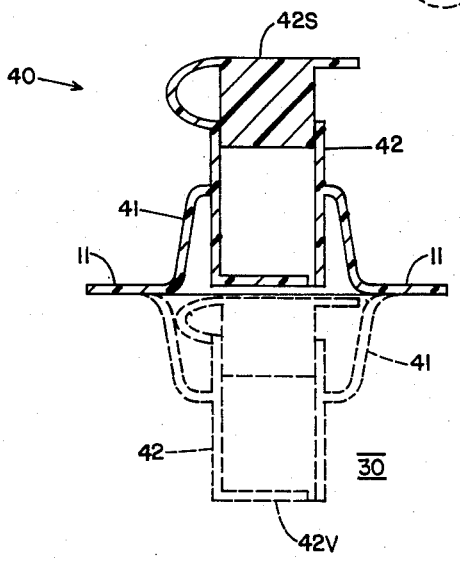
FIG. 5
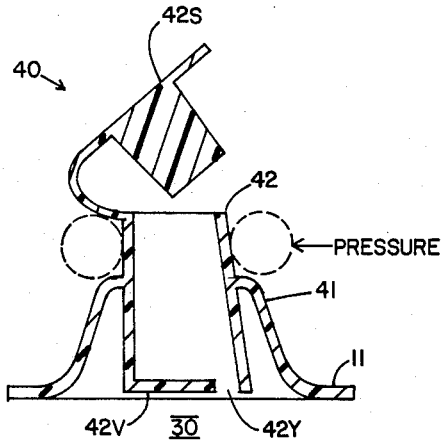
FIG. 5A

FLOTATION SLEEPING MATTRESS CONSTRUCTIONS

BACKGROUND OF THE INVENTION

In drawing FIG. 1, reference characters 10–17, "L", and "W" thereof adequately describe a rudimentary prior art flotation sleeping mattress adapted to be inflated by water or air flotation fluid. Such prior art flotation mattress comprises a fluid-inflatable shell 10 defined by six substantially rectangular flexible fluid-impervious panels 11–16 (e.g. thermoplastic vinyl resinous sheeting) and at least one panel (e.g. top-panel 11) being provided with a spout means therethrough (e.g. tubular spout 17 for permitting the introduction-/evacuation of filling water).

Of the six rectangular panels 11–16 defining six-sided shell 10, two are horizontal broad-panels including a top-panel 11 overlying a dimensionally similar bottom-panel 12 and both having four lineal edges including:

a pair of substantially parallel lengthier longitudinal-edges (e.g. 11A–11B, 12A–12B) defining therebetween a finite lateral-width "W" for the top-panel 11 and for the bottom-panel 12; and a pair of substantially parallel shorter lateral-edges (e.g. 11M–11N, 12M–12N) defining therebetween a finite longitudinal-length "L" for top-panel 11 and for bottom-panel 12.

Six-sided shell 10 also includes two dimensionally similar and longitudinally extending uprightable side-panels 13 and 14 and each having continuous water-impervious connections of said finite longitudinal-length "L" along respective lineal edges of the broad-panels (e.g. side-panel 13 along edges 11A and 12A, and side-panel 14 along edges 11B and 12B). Finally, six-sided shell 10 includes two dimensionally similar and laterally extending uprightable end-panels 15 and 16 and each having continuous fluid-impervious connections of said finite lateral-width "W" along respective lineal edges of the broad-panels (e.g. end-panel 15 along edges 11M and 12M, and end-panel 16 along edges 11N and 12N). Thus, for example, the shell 10 might be filled with water, such as through the cappable (e.g. 18) tubular spout 17, to provide an operational rudimentary flotation sleeping mattress.

The prior art flotation sleeping mattress as described in the two immediately preceeding paragraphs exhibits the undesireable phenomenon of occupant induced abrupt fluid displacements. In the case of water filled mattresses, this phenomenon is exhibited as undulating water waves that are particularly objectionable in the lateral direction. In the case of air inflated mattresses, the phenomenon is exhibited as objectionable bulging. And in the water inflated mode, there is the problem of purging air bubbles from the water flotation medium.

GENERAL OBJECTIVES OF THE INVENTION

Accordingly, in view of the foregoing, objectives of the present invention include the provision of flotation sleeping mattress constructions wherein:

(a) the undesireable abrupt fluid displacement or waving phenomenon associated with prior art water-inflated mattresses be drastically reduced and substantially eliminated;

(b) the undesireable abrupt fluid displacement or bulging phenomenon associated with prior art air-inflated mattresses be drastically reduced and substantially eliminated;

(c) the provision of convenient and reliable means for purging air entrapped within a water-inflated mattress; and (d) the provision of a selectably water-inflatable or air-inflatable mode for the same mattress construction, and in either inflation mode being substantially free of undesireable abrupt fluid displacement phenomena as the occupant moves about.

GENERAL STATEMENT OF THE INVENTION

With the above general objectives in view, and together with more specific objectives which will become more apparent as this description proceeds, flotation sleeping mattress constructions of the present invention generally comprise, in addition to the spouted six-sided shell of the prior art: a plurality of substantially parallel rectangular uprightable baffle-panel partitions of the fluid-impervious type, each said baffle-panel being substantially parallel to (but somewhat shorter than) a top-panel lineal-edge, each said baffle-panel having linearly extending continuous fluid-impervious connections to the top-panel and bottom-panel, thereby providing a plurality of linearly extending and solely terminally communicating internal chambers within the shell that militates against abrupt displacements of the inflating fluid as the mattress occupant moves about; at least one, and preferably a plurality of, air-relief valves extending from one or more internal chambers through the shell and thereby providing a purging means for air bubbles entrapped within a water-inflated mattress; and preferably, air-impervious cap for the spout means and thereby permitting the same mattress construction to be alternatively employed as an air-inflatable type structure.

GENERAL DESCRIPTION OF THE DRAWING

In the drawing, wherein like characters refer to like parts in the several views, and in which.

Figure 1:
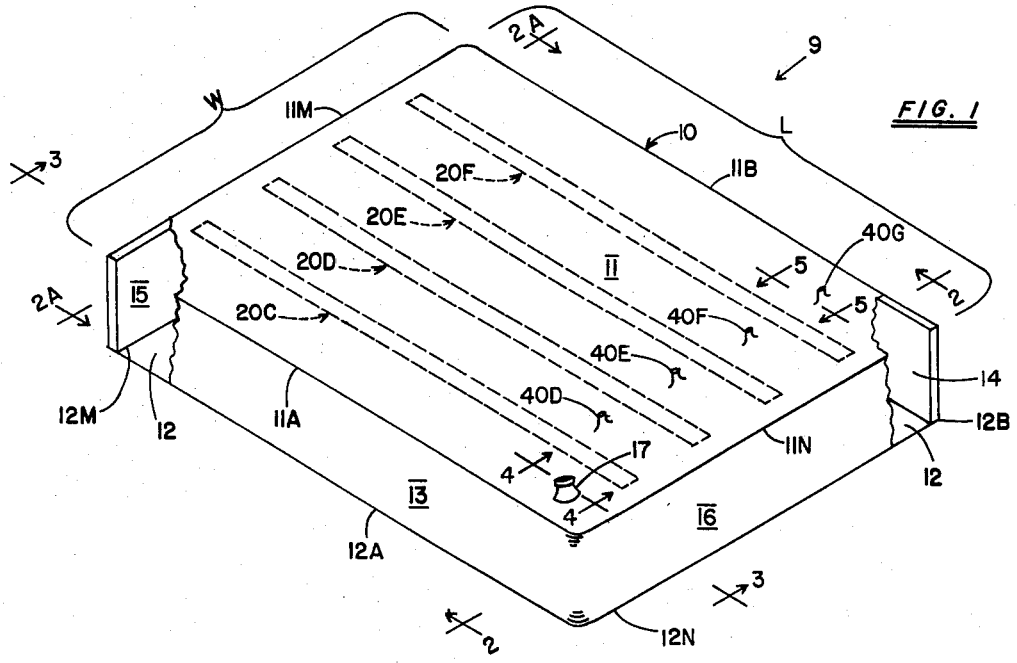
FIG. 1 is a perspective view of a representative embodiment of the improved flotation sleeping mattress of the present invention and which, as previously mentioned, includes certain rudimentary elements of the prior art.
Figure 2:
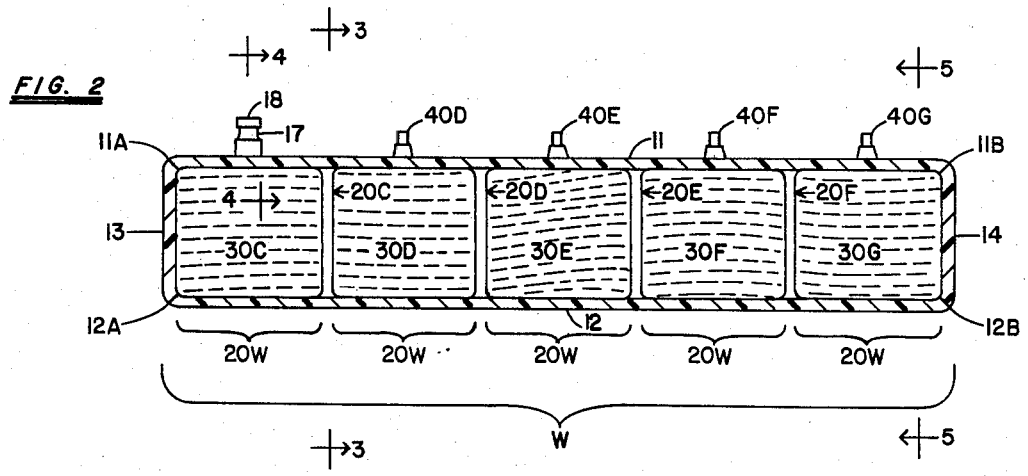
FIG. 2 is a laterally extending sectional elevational view taken along lines 2—2 of FIGS. 1 and 3 and which is a substantial mirror image of a sectional elevational view taken along line 2A—2A of FIG. 1.
Figure 3:
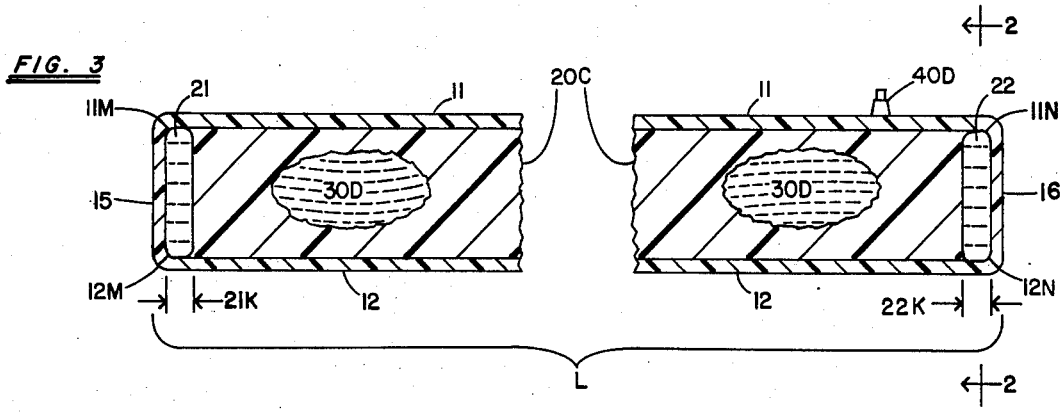
FIG. 3 is a longitudinally extending sectional elevational view taken along lines 3—3 of FIGS. 1 and 2.

FIG. 4 is a detail sectional elevational view of a filling spout taken along lines 4—4 of FIGS. 1 and 2; and FIG. 5 is a detail sectional elevational view of an air-relief valve taken along lines 5—5 of FIGS. 1 and 2; and FIG. 5A is a similar detail elevational view but showing the actuated mode for the air-relief valve.

DETAILED DESCRIPTION OF THE DRAWING

Representative embodiment 9 of the improved flotation sleeping mattress construction includes elements 10–17, "L", and "W" already described hereabove. In addition to prior art elements 10–17, "L", and "W", improved construction 9 comprises a plurality of substantially rectangular baffle-panels 20 fabricated of fluid-impervious material that is preferably similar to that employed for shell external panels 11–16. Thus, for example, external panels 11–16 and the baffle-panels 20 might all be vinyl or other selected thermoplastic resinous material. Each baffle-panel is substantially parallel to an arbitrarily selected lineal edge of the top-panel 11. In embodiment 9, baffle-panels 20 extend directionally longitudinally (i.e. parallel to top-panel edges 11A–11B and to bottom-panel edges 12A–12B) and are spaced at laterally consecutive regular-intervals 20W. In the said condition, one lineal longitudinal edge of each baffle-panel 20 has a heat-sealed or other continuous fluid-impervious connection to top-panel 11 and the other lineal longitudinal edge of each baffle-panel 20 has a similar connection to bottom-panel 12. The longitudinally extending baffle-length of respective baffle-panels 20 bears a ratio within the range of 0.90 to 0.99 as compared to the top-panel longitudinal-length "L", and each baffle-panel is spatially separated (i.e. at 21, 22) from the end-panels 15 and 16 by about two-inches or less as indicated at 21K and at 22K. Thus, the parallel emplaced baffle-panel partitions 20, together with side-panels 13 and 14, provide within shell 10 a plurality of linearly extending and solely terminally communicating (21, 22) parallel internal chambers 30 of generally rectangular cross-sectional shapes. Specifically: side-panel 13 and baffle-panel 20C provide therebetween the linearly longitudinally extending internal chamber 30C; between baffle-panels 20C and 20D there is a similar chamber 30D; between baffle-panels 20D and 20E there is another such chamber 30E; between baffle-panels 20E and 20F there is another such chamber 30F; and between baffle-panel 20F and shell side-panel 14 there is yet another such chamber as 30G.

As already alluded to, water or air fluid inflated into embodiment 9 (e.g. through cappable spout 17) causes baffle-panels 20 and shell panels 13–16 to assume an upright condition whereby the fluid-inflated mattress is ready for supporting an occupant upon horizontal top-panel 11. However, by virtue of the baffle-panel partitions 20 alongside respective fluid-inflated chambers 30, occupant movement along top-panel 11 does not result in objectionable abrupt fluid dispacements, namely the undulate wave or bulging problems attendant with the prior art. Instead, any incipient fluid displacement initiated by the moving occupant is resisted by the fluid-impervious baffle-panel partitions 20 and is benignly dissipated through the small gaps 21–22 at the ends of each arrested baffle-panel. In the latter vein, the regular-intervals 20W between baffle-panels 20 should be sufficiently frequent to adequately resist abrupt intra chamber fluid dispacements as the occupany moves about. It has been determined that such regular-intervals 20W should not exceed about eight-inches; though regular-intervals smaller than about four-inches are acceptable, they are economically impractical from the mattress fabrication standpoint.

Though the presence of baffled and terminally communicating internal chambers 30 does substantially eliminate the objectionable abrupt fluid displacement problem, a troublesome side affect caused by such efficaceous chambers (30) is the difficulty in purging air bubbles likely to be entrapped within the serpentine network (30) of flotation water. However, this troublesome side affect is successfully overcome by utilizing one or more air-relief valves 40 extending from at least one, and preferably a plurality of, internal chambers 30 and through a broad-panel. Herein, laterally aligned air-relief valves 40D, 40E, 40F, and 40G, extend through top-panel 11 and into chambers 30D, 30E, 30F, and 30G, respectively. As seen in FIG. 5, each such air-relief valve 40 might comprise as structurally continuous resinous parts: a dimple like extension 41 from resinous top-panel 11; and a tube 42 integrally surrounded by dimple 41 and the tube being integrally equipped with a lower flapper-valve 42V and with an upper cap 42S. As indicated in FIG. 5 phantom line, the flexibly dimple-connected (41) air-relief valve 40 is vertically depressibly locatable below top-panel whenever the mattress is in the occupied state. However, as indicated in FIG. 5 solid line and more particularly in FIG. 5A at phantom condition, pinching pressure exerted to the upper portion of valve tube 42 establishes flapper-valve gap 42Y and through which water entrapped air bubbles might be purged to the ambient environment.

Drawing FIG. 4 depicts a prior art tubular filling spout connected in vertically depressible dimple fashion to mattress top-panel 11 and provideable with a threadedly engageable and disengageable cap 18. Cap 18 is herein provideable with a resiliently compressible air-impervious resinous liner 19 and which provides an air tight seal whenever air is to be selected as an alternate inflation fluid for mattress representative embodiment 9.

From the foregoing, the construction and operation of the flotation sleeping mattress constructions of the present invention will be readily understood and further explanation is believed to be unnecessary. However, since numerous modifications and changes will readily occur to those skilled in the art, it is not desired to limit the invention to the exact construction shown and described, and accordingly, all suitable modifications and equivalents may be resorted to, falling within the scope of the appended claims.

Appendix

| Mattress Style | Longitudinal Length | Lateral Width |
|---|---|---|
| Super Snuggle | 84 inches | 48 inches |
| Queen Size | 84 inches | 60 inches |
| King Size | 84 inches | 72 inches |

What is claimed is as follows:

1. In a flotation sleeping mattress of the fluid-inflatable type externally defined by six substantially rectangular flexible fluid-impervious resinous external panels including: two broad-panels including a top-panel overlying a dimensionally similar bottom-panel and both comprising four lineal edges including a pair of substantially parallel lengthier longitudinal-edges defining therebetween a finite lateral-width for the mattress top-panel and a pair of substantially parallel shorter lateral-edges defining therebetween a finite longitudinal-length for the mattress top-panel; two dimensionally similar and longitudinally extending side-panels and each having fluid-impervious connections of said finite longitudinal-length along respective longitudinal-edges of the broad-panels; and two dimensionally similar and laterally extending end-panels and each having lineal fluid-impervious connections of said finite lateral-width along respective lateral-edges of the broad panels, the improvement of:

(A) a plurality of substantially parallel flexible rectangular baffle-panels of the fluid-impervious resinous type, each said baffle-panel being substantially parallel to a said side-panel and bearing a ratio within the range of 0.90 to 0.99 as compared to said finite longitudinal-length, and each such baffle-panel having linearly extending continuous fluid-impervious connections to the broad-panels, whereby said parallel baffle-panels provide a plurality of linearly extending and solely terminally communicating internal chambers within said fluid-inflatable mattress and wherein such baffle-panels partitions resist abrupt fluid displacements directionally normal thereto whenever the mattress occupant moves along a plane overlying the mattress top-panel, and the said baffle-panels being located at laterally consecutive regular-intervals of about four to eight inches and whereby said lateral-width bears a ratio of at least about eight as compared to the baffle-panels regular-intervals; and (B) a fluid filling spout equipped with a removable cap and said spout extending through the mattress into one internal chamber, and resinous air-relief valves in structurally continuously attached condition to the top-panel and each being relegated to communication with respective of the remaining internal chambers, each said resinous air-relief valve comprising a flexible valve tube with a lower flapper valve and an upper cap, said valve tube being connected to the top panel with a flexible extension and being vertically movable to assume positions above and below the top-panel whereby when a pinching pressure is exerted on the upper portion of the valve, tube a flapper valve gap is established permitting the purging of air bubbles.

2. The flotation type sleeping mattress of claim 1 wherein each of said baffle-panels is spatially separated from both end-panels whereby neighboring internal chambers delineated thereby communicate at both terminii alongside the two end-panels.

3. The flotation type sleeping mattress of claim 2 wherein each said spatial separation at the end-panels is less than about two inches.

4. The flotation type sleeping mattress of claim 2 wherein the ratio is at least about ten.

5. The flotation type sleeping mattress of claim 4 wherein the ratio is at least about twelve in a king-size bed.

* * * * *